US005547303A

United States Patent [19]

Pyrozyk

[11] Patent Number: 5,547,303

[45] Date of Patent: Aug. 20, 1996

[54] APPARATUS FOR DISPENSING AND APPLYING FLUID

[75] Inventor: Ronald R. Pyrozyk, Penticton, Canada

[73] Assignee: Okanagan House Inc., Penticton, Canada

[21] Appl. No.: 521,458

[22] Filed: Aug. 30, 1995

Related U.S. Application Data

[63] Continuation of Ser. No. 237,985, May 4, 1994, abandoned.

[51] Int. Cl.[6] ..... A46B 11/00

[52] U.S. Cl. ..... 401/270; 401/183; 401/186; 401/269; 401/277; 401/288

[58] Field of Search ..... 401/183, 186, 401/270, 277, 207, 269, 288

[56] References Cited

U.S. PATENT DOCUMENTS

| | | | |
|---|---|---|---|
| 1,455,911 | 2/1923 | Rayder | 401/270 X |
| 2,669,740 | 2/1954 | Main | 401/277 |
| 2,718,023 | 9/1955 | Douglass, Jr. | 401/186 |
| 3,029,464 | 4/1962 | Springmeier | 401/183 |
| 3,106,741 | 10/1963 | Stoner | 401/183 |
| 3,896,822 | 7/1975 | Zimmerman | 401/186 X |
| 4,066,367 | 1/1978 | Sherosky | 401/270 X |
| 4,726,386 | 2/1988 | Schultz | 401/186 X |
| 4,846,599 | 7/1989 | Seddon | 401/207 X |

*Primary Examiner*—Steven A. Bratlie
*Attorney, Agent, or Firm*—Shlesinger, Arkwright & Garvey

[57] ABSTRACT

An apparatus and method for dispensing fluid from a container. The apparatus includes a conduit, a brush head and a coupling. The conduit is operable to be placed in fluid communication with the container. The brush head has bristles, a fluid receiving opening for receiving the fluid and a fluid dispersing opening in communication with the fluid receiving opening for dispersing the fluid amongst the bristles. The coupling is operable to be placed in fluid communication with the conduit and cooperates with the brush head such that the brush head is movably secured to the coupling and moveable between first and second positions relative to the coupling. The coupling has a plug operable to plug the fluid receiving opening to prevent fluid from flowing from the conduit into the fluid receiving opening when the brush head is in the first position and to permit fluid to flow from the conduit into the fluid receiving opening when the brush head is in the second position.

13 Claims, 3 Drawing Sheets

APPARATUS FOR DISPENSING AND APPLYING FLUID

This is a continuation of application Ser. No. 08/237,985, filed May 4, 1994 now abandoned.

BACKGROUND OF THE INVENTION

This invention relates to an apparatus and method for dispensing fluid from a container and for applying said fluid, particularly for use in dispensing and applying a fluid condiment such as ketchup or prepared mustard.

When cooking meats or other food items, a condiment such as Bar-B-Que sauce, ketchup, or marinate is often applied to enhance flavour. Some chefs prefer to spread the condiment over the food item for even distribution to obtain a more consistent flavour. Present practice is to use a small brush to achieve such spreading.

The use of a brush requires yet another cooking utensil to be kept in inventory and about the cooking area when its use is imminent. This creates an inconvenience to the chef and can promote unsanitary conditions as the brush is often placed on a countertop after use, which transfers a small amount of condiment to the countertop, giving rise to a breeding area for bacteria. What would be desirable is a combined dispenser and applicator for applying condiments to foods without risk of contacting the applicator to a countertop or other surface upon which bacteria can survive. The present invention addresses this need.

SUMMARY OF THE INVENTION

In accordance with one aspect of the invention there is provided an apparatus for dispensing and applying fluid from a container. The apparatus includes a conduit, a brush head and a coupling. The conduit is operable to be placed in fluid communication with the container. The brush head has bristles, a fluid receiving opening for receiving the fluid and a fluid dispersing opening in communication with the fluid receiving opening for dispersing the fluid amongst the bristles. The coupling is operable to be placed in fluid communication with the conduit and cooperates with the brush head such that the brush head is movably secured to the coupling and moveable between first and second positions relative to the coupling. The coupling has a plug operable to plug the fluid receiving opening to prevent fluid from flowing from the conduit into the fluid receiving opening when the brush head is in the first position and to permit fluid to flow from the conduit into the fluid receiving opening when the brush head is in the second position.

Preferably, the coupling includes a first generally circular cylindrical end portion having a first diameter and an inlet opening in fluid communication with the conduit.

Preferably, the coupling includes a brush connecting portion extending from the circular cylindrical end portion, the brush connecting portion having a reduced diameter portion extending from the circular cylindrical portion and an enlarged end portion terminating the reduced diameter portion. Preferably, the enlarged end portion has an axial outlet opening therein, the outlet opening being in communication with the fluid receiving opening of the coupling to supply fluid to the brush head.

Preferably, the brush connecting portion includes a plurality of spaced apart generally axially extending members, the plug being secured to the axially extending members in spaced apart relation to the outlet opening of the coupling and in axial alignment therewith.

Preferably, the brush head includes a shaft portion having an inside wall defining a bore for receiving the brush connecting portion, the inside wall having first and second axially spaced apart and axially aligned grooves therein for cooperating with the enlarged end portion to lock the brush in the first and second positions. Preferably, the fluid receiving opening of the brush head is disposed in the bore and preferably, the enlarged end portion engages the first groove when the brush head is in the first position and the enlarged end portion engages the second groove when the brush head is in the second position.

Preferably, the conduit is relatively straight and rigid and has first and second end portions, the first end portion being in communication with the container and the coupling being connected to the second end portion.

Preferably, the apparatus includes a cover for covering the container, the cover having an opening, the conduit extending through the opening.

Preferably, the conduit is extendable and retractable relative to the cover such that the first end portion is operable to extend into the container while the second end portion extends outside of the container. Preferably, the conduit has a stopper mounted on the first end portion for preventing the first end portion from being retracted from the opening.

Preferably, the apparatus includes a case having first and second engaging portions hinged together, for completely encapsulating the brush head to reduce exposure of the bristles to air.

In accordance with another aspect of the invention there is provided a method of dispensing and applying fluid, the method comprising the steps of:

a) moving a brush head relative to a coupling in fluid communication with a container holding the fluid to unplug a fluid receiving opening in the brush head;

b) conducting fluid through a conduit, from the container into the fluid receiving opening in the brush head; and c) dispersing fluid from a fluid dispersing opening in the brush head such that fluid is dispersed amongst bristles secured to the brush head.

In accordance with another aspect of the invention there is provided a fluid dispensing apparatus comprising a container, a cover, a conduit, a brush head and a coupling. The is operable to hold fluid and has a top portion and an interior portion, the top portion having an opening in communication with the interior of the container. The cover is engageable with the top portion of the container to cover the container to prevent escape of fluid therefrom, the cover having an opening in fluid communication with the opening in the top portion. The conduit extends through the opening and is sealed relative thereto. The conduit has first and second opposite end portions, the first end portion extending into the interior of the container and the second end portion extending externally of the container. The brush head has bristles and a fluid receiving opening for receiving the fluid and has a fluid dispersing opening in communication with the fluid receiving opening for dispersing the fluid amongst the bristles. The coupling is in fluid communication with the conduit and cooperates with the brush head such that the brush head is movably secured to the coupling and is moveable between first and second positions relative to the coupling. The coupling has a plug operable to plug the fluid receiving opening to prevent fluid from flowing from the conduit into the fluid receiving opening when the brush head is in the first position and to permit fluid to flow from the conduit into the fluid receiving opening when the brush head is in the second position.

By providing the apparatus with a cover having standard dimensions, the apparatus can be used directly on conventional sauce containers. The retractability of the conduit relative to the cover allows the apparatus to be made compact for storage in a refrigerator, for example. The cooperation of the brush head and the coupling act as a valve operable to selectively open or close the container thereby selectively sealing the interior of the container from air when the apparatus is not in use. This impedes bacterial growth. The apparatus permits quick and convenient application of sauces to foods and can be left on the container until the contents thereof have been fully dispensed. Thus the apparatus need not be taken to the cooking area as a separate device but rather a single unit comprising the dispenser/applicator and container can be taken to the cooking area as a single device. After use, the brush need merely be rinsed off with water and the entire device placed in storage.

BRIEF DESCRIPTION OF THE DRAWINGS

In drawings which illustrate embodiments of the invention.

DETAILED DESCRIPTION

Figure 1:
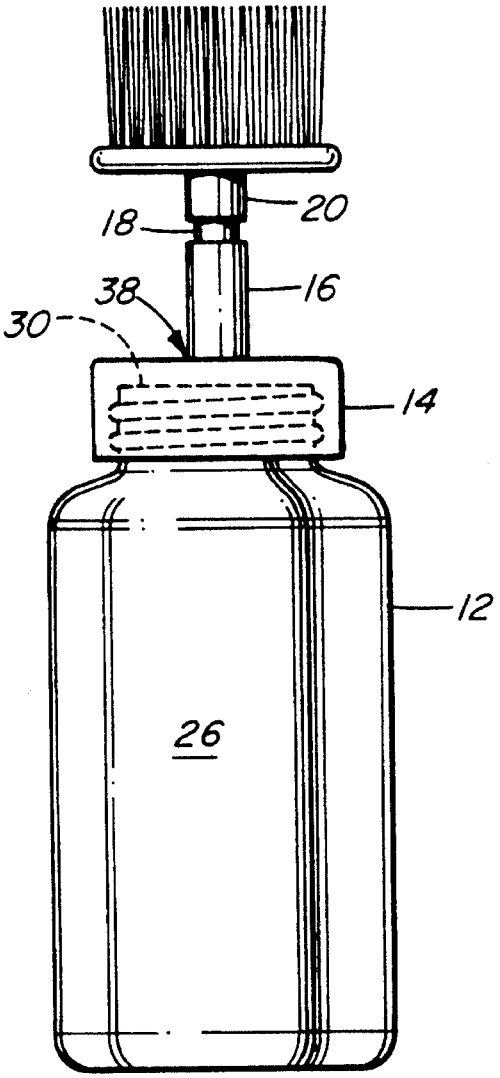
FIG. 1 is a side view of an apparatus according to a first embodiment of the invention.

Referring to FIG. 1, a fluid dispensing apparatus according to a first embodiment of the invention is shown generally at 10. The apparatus includes a container 12 for holding fluid, a cover 14 for covering the container, a conduit 16 extending through the cover, a coupling 18 secured to the conduit, and a brush head 20 connected to the coupling.

Container

Figure 2:
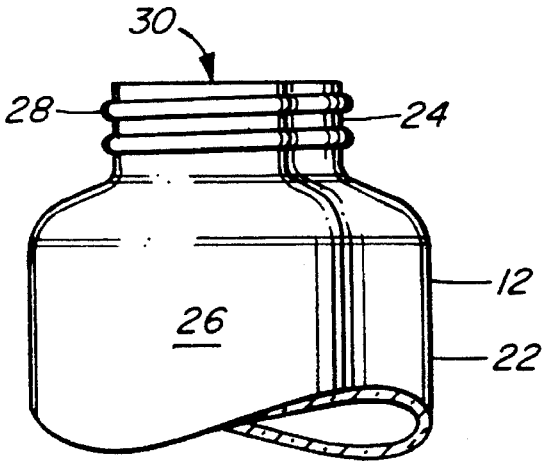
FIG. 2 is a side view of a container according to a first embodiment of the invention.

Referring to FIG. 2, in this embodiment, the container 12 is a conventional resilient plastic condiment dispenser container and has a main body portion 22 having a top portion 24 and an interior portion 26. The top portion 24 has conventional male screw threads 28 and has an opening 30 in communication with the interior portion 26 to permit filling of the interior portion with fluid to be dispensed and to permit dispensing of fluid from the interior portion as required.

Cover

Figure 3:
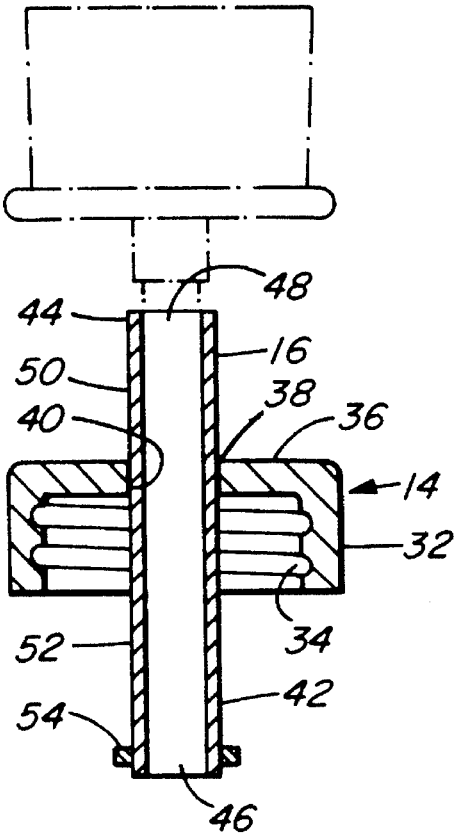
FIG. 3 is a cross-sectional view of a cover and conduit according a first embodiment of the invention.

Referring to FIG. 3, the cover is shown generally at 14. The cover 14 has a cylindrical portion 32 having female screw threads 34 which are complementary to the male threads shown in FIG. 2 and has a circular disk portion 36 having a circular opening 38 of a fixed diameter disposed centrally therethrough and defined by a cylindrical wall 40. The female screw threads 34 enable the cover 14 to be tightly secured in fluid-tight relation to the container 12 as shown in FIG. 1 to prevent the escape of fluid from the container. When the cover 14 is secured to the container as shown in FIG. 1, the opening 38 is in communication with the opening 30 in the top portion of the container and is therefore in communication with the interior portion 26 of the container.

Still referring to FIG. 3, the conduit 16 extends through the opening 38 in the cover and has first and second opposite end portions 42 and 44 having first and second openings 46 and 48 respectively, in communication with each other. The conduit 16 further has an intermediate portion 50 disposed between the first and second end portions 42 and 44 for conducting fluid between the first and second openings 46 and 48.

Generally, the conduit 16 is straight and relatively rigid and has a constant diameter which is defined by an outer wall surface 52 of the conduit. The diameter is very nearly equal the fixed diameter of the opening 38 in the cover such that the outer wall surface 52 is generally in fluid-tight relation with the cylindrical wall 40. In effect therefore, the conduit 16 is sealed relative to the opening 38 in the cover.

The intermediate portion 50 is operable to slide relative to the opening 38 in the cover such that the conduit 16 may be extended or retracted relative thereto. A stopper 54 having an annular shape is secured to the first end portion 42 to prevent the first end portion 42 from passing through the opening 38 and retracted therefrom. Hence, the first end portion 42 is operable to extend into the interior portion 26 of the container 12 while the second end portion 44 extends externally of the container 12. The first opening 46 is therefore in communication with the container Coupling Referring to FIG. 4, the coupling 18 is connected to the second end portion 44 of the conduit 16 and includes a first generally circular cylindrical end portion 56 having a first diameter 58 and a fluid receiving opening 60 which is in communication with the second opening 48 in the second end portion 44 of the conduit 16 when the coupling 18 is secured to the conduit as shown in FIG. 1. Hence, the coupling 18 is in fluid communication with the conduit 16.

The coupling 18 further includes a brush connecting portion 62 extending from the circular cylindrical end portion 56. The brush connecting portion 62 has a truncated conical portion 64 followed by a cylindrically shaped reduced diameter portion 66 having a diameter 68 slightly less than the first diameter 58. The reduced diameter portion 66 is followed by an enlarged end portion 70 which terminates the reduced diameter portion 66. The enlarged end portion 70 has a diameter 72 approximately equal to the diameter 58 of the circular cylindrical end portion 56 and has an axial outlet opening 74 in communication with the fluid receiving opening 60

The brush connecting portion 62 further includes a plurality of spaced apart, generally axially extending and inwardly tapered members 76, in this embodiment, three members, and a tapered plug 78 secured to distal end portions 80 of the axially extending members 76 in spaced apart relation to the outlet opening 74 and in axial alignment therewith. Hence, in this embodiment, three fluid outlets only two of which are shown at 82 and 84, defined by the plug 78 and the three axially extending members 76 are provided in the coupling 18.

Brush Head

Figure 5:
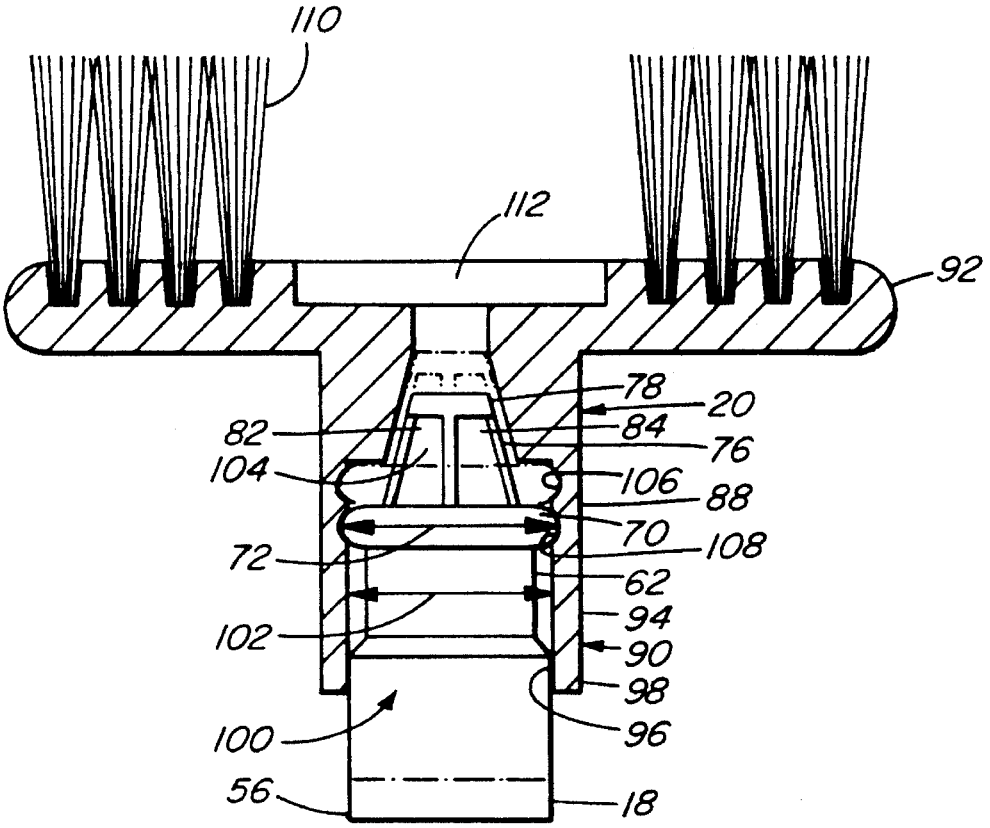
FIG. 5 is a cross-sectional view of a brush head according to a first embodiment of the invention.

Referring to FIG. 5, the brush head 20 has a body portion 88 including a shaft portion 90 and a bristle connecting portion 92. The shaft portion 90 has a cylindrical wall 94 having cylindrical inside and outside surfaces 96 and 98, the inside surface 96 defining a bore 100 having a diameter 102 approximately equal to the diameter 72 of the enlarged head portion 70 of the coupling 18, for receiving the brush connecting portion 62 thereof. The bore 100 is terminated in a reduced diameter fluid receiving opening 104 which is operable to receive the tapered plug 78 of the brush connecting portion 62.

The bore 100, the circular cylindrical end portion 56 and the enlarged end portion 70 are cooperatively dimensioned to permit the circular cylindrical end portion 56 and the enlarged end portion 70 to simultaneously contact the inside surface 96 of the cylindrical wall 94 through a distance of linear travel of the brush head 20 relative to the coupling 18. Thus, the enlarged end portion 70 and the circular cylindrical end portion 56 act to guide the shaft portion 90 in linear movement between first and second positions, the first position being a retracted position, shown with the relative position of the coupling in broken outline and the second position being an extended position shown with the relative position of the coupling in solid outline.

The plug 78 and axially extending members 76 are suitably dimensioned such that the plug is received in the reduced diameter fluid receiving opening 104 when the brush head 20 in is the first position and such that the plug 78 is fully received in the fluid receiving opening 104 when the brush head is in the second position. Since the bore 100 is of larger diameter than the fluid receiving opening 104, fluid can flow from the three fluid outlets only two of which are shown at 82 and 84, in the coupling 18, through the bore 100 and into the fluid receiving opening 104 when the brush head 20 is in the second position and is prevented from entering the fluid receiving opening 104 by the tapered plug 78, when the brush head 20 is in the first position.

Referring to FIGS. 1 and 5, in effect, the coupling 18 is in fluid communication with the conduit 16 and cooperates with the brush head 20 such that the brush head 20 is movably secured to the coupling 18 and moveable between first and second positions relative to the coupling, the coupling having a plug 78 operable to plug the fluid receiving opening 104 to prevent fluid from flowing from the conduit into the fluid receiving opening when the brush head 20 is in the first position and operable to permit fluid to flow from the conduit into the fluid receiving opening 104 when the brush head 20 is in the second position.

Referring to FIG. 5, in this embodiment, the inside surface 96 has first and second circular grooves 106 and 108 formed therein in axially spaced apart relation. The grooves are dimensioned to partially engage the enlarged end portion 70 to sufficiently fix it in the first and second positions respectively as desired. The grooves 106 and 108 are dimensioned to only partially engage the enlarged end portion 70 to allow a user to move the brush head 20 from one position to the other by merely applying a brief impulse of force to disengage the enlarged end portion 70 with an engaged groove 106 or 108.

The bristle connecting portion 92 is generally of linear rectangular shape and has a plurality of outwardly extending bristles 110 secured thereto. At approximately midway therealong, the bristle connecting portion has a fluid dispersing opening 112 disposed amongst said bristles. The fluid dispersing opening 112 is in communication with the fluid receiving opening 104. Fluid emanating from the fluid dispersing opening 112 is dispersed amongst the bristles 110.

Operation

Referring to FIG. 1, to use the fluid dispensing apparatus according to the invention, the cover 14 is removed from the container 12 by counterclockwise relative rotation in the conventional manner, to expose the opening 30 in the container as seen in FIG. 2. Fluid, such as ketchup, mayonnaise, prepared mustard or the like is then deposited into the interior portion 26 of the container 12. When a desired amount of fluid has been deposited into the container, the cover 14 is screwed back on, thereby restoring the apparatus to that shown in FIG. 1.

The conduit 16 is then extended or retracted from the cover 14 any desired amount and the brush head 20 is moved relative to the coupling be into the second position shown in FIG. 5 (solid outline) whereupon the enlarged end portion 70 is partially engaged with the second groove bee to lock the brush head 20 in the second position. In this position, the plug 78 is not received in the fluid receiving opening 104 and the outlet opening 74 and the fluid receiving opening 104 are in fluid communication with each other.

Figure 4:
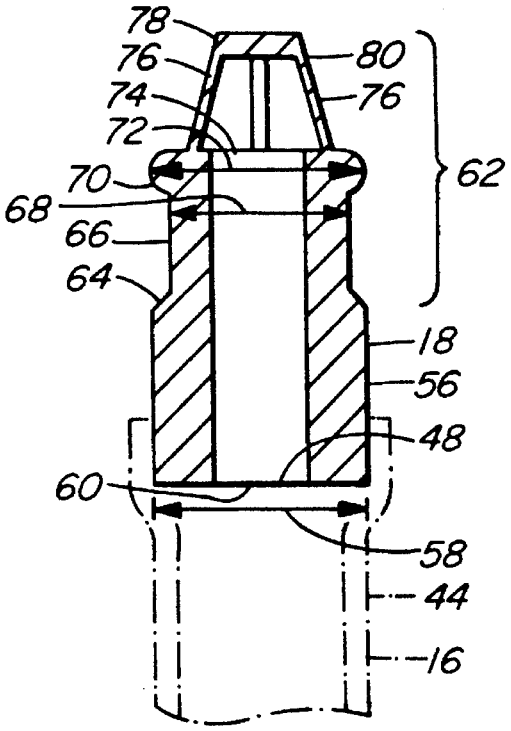
FIG. 4 is a cross-sectional view of a coupling according to a first embodiment of the invention.

In this embodiment, the container 12 is then inverted or partially inverted (not shown) and squeezed to apply pressure to the fluid in the interior portion 26 of the container 12. Referring to FIGS. 3, 4 and 5 such pressure forces the fluid into the first opening 46 in the conduit, through the conduit 16, out of the second opening 48 in the conduit and into the fluid receiving opening 60 in the coupling 18, through the coupling, out of the three fluid outlets only two of which are show at 82 and 84, through the bore 100, into the fluid receiving opening 104, through the brush head 20 and out of the fluid dispersing opening 112 where it is released amongst the bristles 110. The bristles absorb the fluid and thereby permit it to be applied to meats, in the case of the present embodiment, or to any surface in general.

Figure 6:
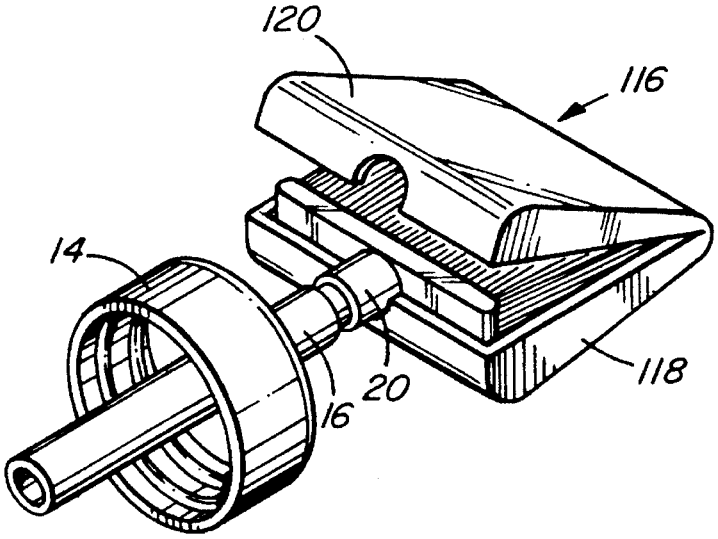
FIG. 6 is a cross sectional view of a cover for covering the brush head shown in FIG. 5.

Referring to FIG. 5, when a desired amount of fluid has been dispensed, squeezing of the container 12 is ended and the brush head 21 is moved into the first position (broken outline) where the plug 78 is received in the fluid receiving opening 104 thereby sealing the container 12 and preventing further supply of fluid to the fluid receiving opening 104. Further dispensing of fluid is thereby prevented and air is prevented from entering the container 12. Referring to FIG. 6, optionally, the apparatus may include a case 16 having first and second engaging portions 118 and 120 hinged together, for completely encapsulating the brush head 120 to reduce exposure of the bristles 110 to air when the apparatus is not in use. While specific embodiments of the invention have been described and illustrated, such embodiments should be considered illustrative of the invention only and not as limiting the invention as construed in accordance with the accompanying claims.

What is claimed is:

1. An apparatus for dispensing and applying fluid from a container, the apparatus including;

a) a cover engageable with a top portion of said container, the cover having an opening in fluid communication with said container;

b) a rigid conduit extending through said opening in said cover, said rigid conduit having first and second end portions, the first end portion having a first opening and being operable to project inside said container when said cover is on said container, such that said first opening is in fluid communication with said container, and said second end portion having a second opening in communication with said first opening, said second end portion being operable to project outside of said container, the conduit being moveable relative to said cover such that said conduit is extendable and retractable relative to said container;

c) a brush head having bristles, a fluid receiving opening and a fluid dispersing opening in communication with said fluid receiving opening for dispersing said fluid received at said fluid receiving opening amongst said bristles, said fluid receiving opening and said fluid dispersing opening being immediately adjacent each other; and d) a coupling connected to said second end portion of said conduit, said coupling being connected to and in fluid communication with said second opening in said conduit and cooperating with said brush head to movably secure said brush head to said second end portion of said conduit such that said brush head is operable to be positioned remotely from said container by extension of said conduit, the coupling securing said brush head such that said brush head is axially moveable between first and second positions relative to said coupling, said coupling having a plug operable to plug said fluid receiving opening to prevent fluid from flowing from said second opening in said conduit into said fluid receiving opening when said brush head is in said first position and operable to permit fluid to flow from said second opening in said conduit into said fluid receiving opening when said brush head is in said second position.

2. An apparatus as claimed in claim 1 wherein said coupling includes a first generally circular cylindrical end portion having a first diameter and an inlet opening in fluid communication with said conduit.

3. An apparatus as claimed in claim 2 wherein said coupling includes a brush connecting portion extending from said circular cylindrical end portion.

4. An apparatus as claimed in claim 3 wherein said brush connecting portion has a reduced diameter portion extending from said circular cylindrical portion.

5. An apparatus as claimed in claim 4 wherein said brush connecting portion includes an enlarged end portion terminating said reduced diameter portion, said enlarged end portion having an axial outlet opening therein, said outlet opening being in communication with said fluid receiving opening of said coupling to supply fluid to the brush head.

6. An apparatus as claimed in claim 5 wherein said brush connecting portion includes a plurality of spaced apart generally axially extending members, said plug being secured to the axially extending members in spaced apart relation to said outlet opening of said coupling and in axial alignment therewith.

7. An apparatus as claimed in claim 6 wherein said brush head includes a shaft portion having an inside wall defining a bore for receiving said brush connecting portion.

8. An apparatus as claimed in claim 7 wherein said inside wall has first and second axially spaced apart and axially aligned grooves therein for cooperating with said enlarged end portion to lock said brush in said first and second positions.

9. An apparatus as claimed in claim 8 wherein said fluid receiving opening of said brush head is disposed in said bore.

10. An apparatus as claimed in claim 9 wherein said enlarged end portion engages said first groove when said brush head is in said first position and wherein said enlarged end portion engages said second groove when said brush head is in said second position.

11. An apparatus as claimed in claim 1 wherein said conduit has a stopper mounted on said first end portion for preventing said first end portion from being completely retracted from said opening.

12. An apparatus as claimed in claim 1 wherein said conduit is straight.

13. An apparatus as claimed in claim 1 further including a case having first and second engaging portions hinged together, for completely encapsulating the brush head to reduce exposure of the bristles to air.

* * * * *